US005984386A

United States Patent [19]

Clemens

[11] Patent Number: 5,984,386

[45] **Date of Patent: *Nov. 16, 1999**

[54] PORTABLE PUBLIC RESTROOM STALL DOOR HOLDING DEVICE

[76] Inventor: Sharon A. Clemens, 9902 Silver Strand Dr., Huntington Beach, Calif. 92646-6512

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,687

[22] Filed: Nov. 6, 1997

[51] Int. Cl.[6] ..... E05C 19/18

[52] U.S. Cl. ..... 292/288; 292/162

[58] Field of Search ..... 292/288, 289, 292/145, 137, 300, 162, 156, DIG. 21, 1, 292; 49/394; 52/463

[56] References Cited

U.S. PATENT DOCUMENTS

| | | | |
|---|---|---|---|
| D. 155,314 | 9/1949 | Pessing . | |
| 2,172,610 | 9/1939 | Frank | 292/288 |
| 2,508,218 | 5/1950 | Brewer . | |
| 3,620,483 | 11/1971 | Weinberger | 292/262 |
| 3,997,204 | 12/1976 | Krempp | 292/162 |
| 4,372,592 | 2/1983 | Beese | 292/288 |
| 5,291,760 | 3/1994 | Schrader | 70/14 |

FOREIGN PATENT DOCUMENTS

| | | | |
|---|---|---|---|
| 674854 | 10/1929 | France | 292/145 |

*Primary Examiner*—Flemming Saether
*Assistant Examiner*—Gary Estremsky
*Attorney, Agent, or Firm*—Edgar W. Averill, Jr.

[57] ABSTRACT

A portable public restroom stall door holding device for holding a stall door closed when the lock is broken or inoperative. The device is an elongated C-shaped member which has a pair of gripping edges which may be placed over the top of the stall door and the top or edges of the door post so that the user may temporarily keep the door closed. The device is retained by the user.

8 Claims, 2 Drawing Sheets

PORTABLE PUBLIC RESTROOM STALL DOOR HOLDING DEVICE

BACKGROUND OF THE INVENTION

The field of the invention is door closures and the invention relates more particularly to devices for holding stall doors of restrooms closed when the locking system provided is inoperative.

Anyone who has travelled very much realizes that the maintenance of public restrooms is sporadic at best and it is not at all uncommon that the restroom door lock is inoperative. Since the restroom doors tend to have a biasing action which moves them into an open position, the stall becomes essentially unusable when the door will not stay closed.

One device is patented relating to this problem and that is shown in U.S. Pat. No. 5,253,908. In this device a pair of disk-like members are held on a nylon line and may be tightened at the intersection of the door and the door jam. This device is somewhat cumbersome to use and is also not particularly compact for storage in a purse or in one's pocket.

BRIEF SUMMARY OF THE INVENTION

It is an object of the present invention to provide a device for holding a stall door closed when the latch is inoperative, which device is compact and easy to operate.

The present invention is for a portable public restroom stall door holding device. The device is an elongated generally C-shaped member having a first end, a second end, and a body which spans more than about 180° around the C-shaped portion thereof. The C-shaped member terminates in a pair of parallel gripping edges which are slightly flexible and which can be placed over the stall door and the top of the front panel. If the front panel extends above the top of the stall door top, then the device has a pair of outwardly extending gripping edges which permit the device to be placed over the top of the stall door and slid toward the front panel so that the gripping edges surround the front and back of the front panel. The invention is also for the process of using the holding device.

DESCRIPTION OF THE PREFERRED EMBODIMENTS

Figure 1:
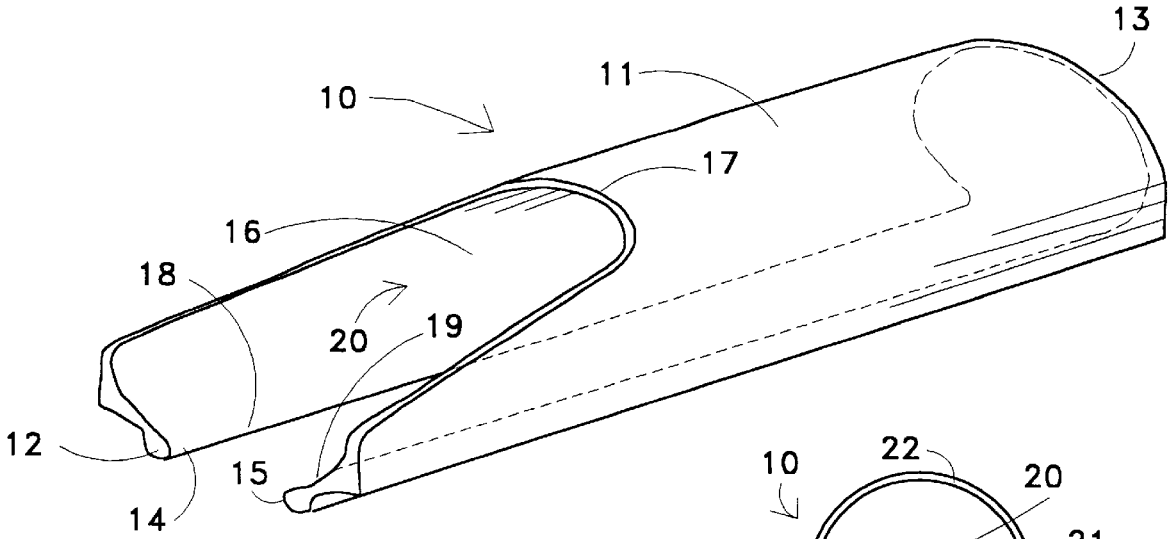
FIG. 1 is a perspective view of the stall holding device of the present invention.

The stall door holding device is shown in perspective view in FIG. 1 and indicated generally by reference character 10. Holder 10 has a body 11 with a first end 12 and a second end 13. Body 11 is an elongated generally C-shaped member oriented so that the open portion of this C is pointed downwardly as shown in FIG. 1. This is done for ease of description and, of course, the device need not be in this position to be operated.

Body 11 has a pair of parallel gripping edges 14 and 15 which are preferably rounded. The body is fabricated from stiff but flexible material, preferably a polymer such as polyvinyl chloride. The device need only be about 4" long and 1¼" in diameter and, thus, may be readily stored in a purse or pocket. It can even be used to hold a packet of facial tissues or other objects so that it takes up almost no room at all.

Figure 2:
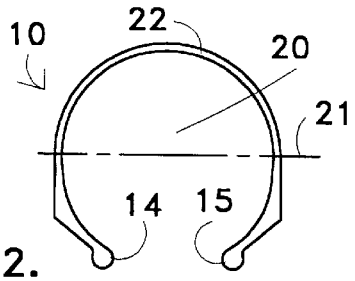
FIG. 2 is a front view thereof.

Preferably, door holder 10 has a recess 16. Recess 16 extends from about half way up first end 12 to an upper recess end 17 along the top of the body. This recess permits the device to be slid forwardly to surround the surfaces of a front panel in the event the top of the stall door is not at the same level as the top of the front panel. The recess 16 forms a pair of extending arms 18 and 19 which surround a central elongated opening 20. The device is shown in front view in FIG. 2 and can be seen to suspend an arc of approximately 310°. Since the device is made from a stiff but flexible material, this permits the parallel gripping edges 14 and 15 to flex outwardly so that they extend over essentially all public restroom stall doors. A bisecting line 21 passes through the center of the curved inner surface. Preferably, the thickness of the polymer above the bisecting line indicated by reference character 22 is thinner than the thickness of the polymer below that point. This is because it is desired that the device flex over this thin portion 22 and be more rigid below this. In this way the flexure is spread out over approximately 180° distance. Gripping edges 14 and 15 are preferably rounded as shown best in FIG. 2 to facilitate the placement of the device over the top or up onto the bottom of a stall door.

Figure 3:
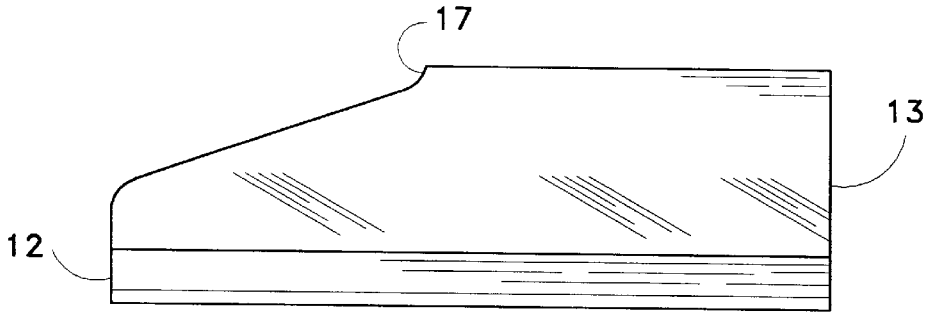
FIG. 3 is a side view thereof.

The device is shown in side view in FIG. 3 where the shape of the recess can be seen to pass from approximately the mid-point of first end 12 up to recess end 17 which is approximately half way between the first and second ends.

Figure 4:
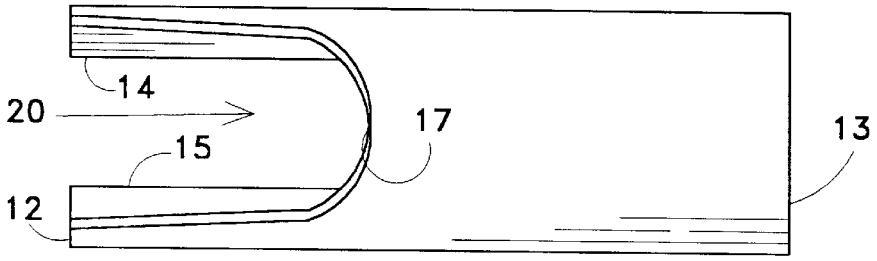
FIG. 4 is a top view thereof.

A top view of the device is shown in FIG. 4 where the generally parallel gripping edges 14 and 15 may be seen as is the elongated opening 20.

Figure 5:
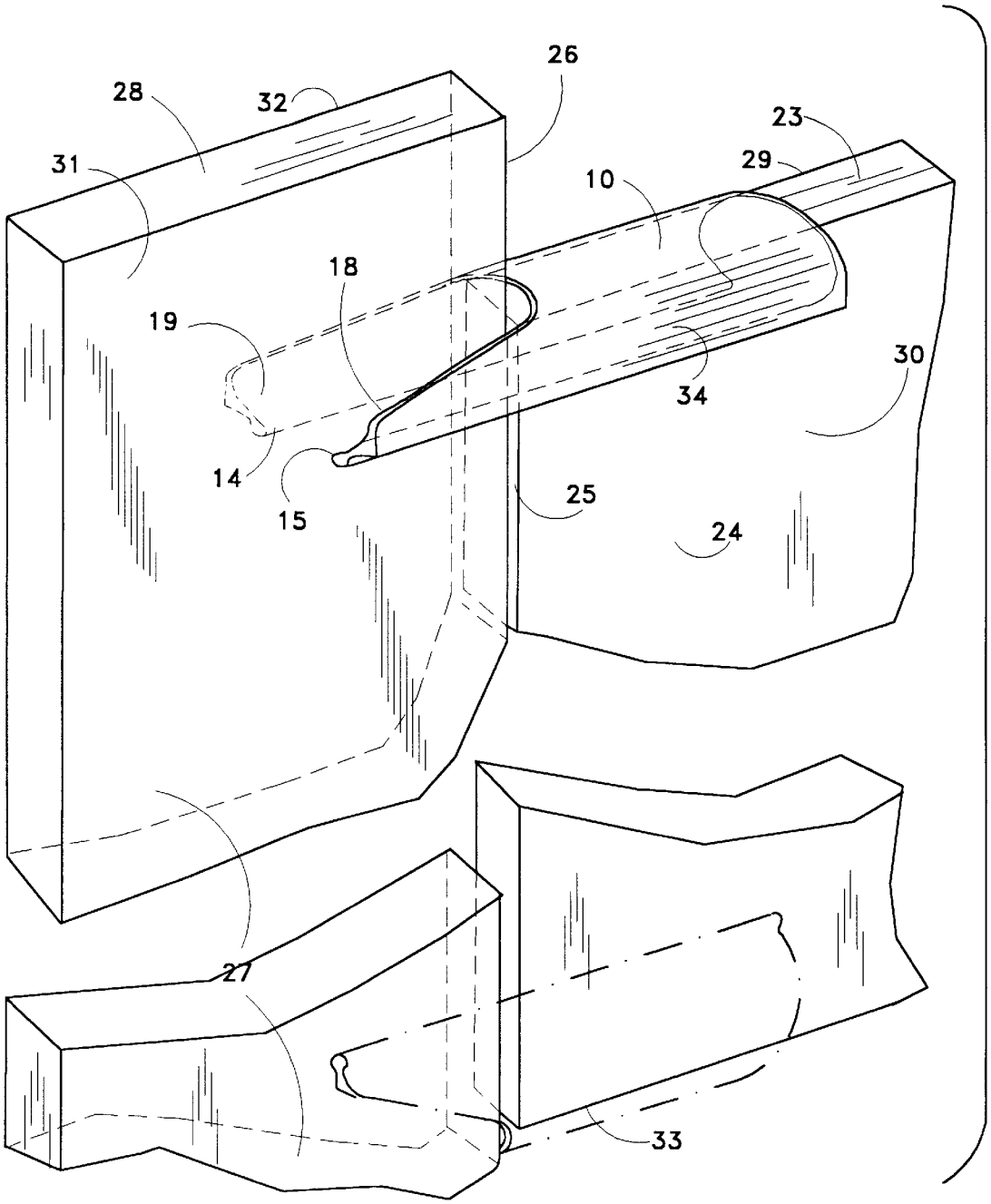
FIG. 5 is a perspective view showing the top and bottom of a stall do as well as a portion of the front panel of a public restroom stall.

Turning now to FIG. 5, the device is shown affixed to the top edge 23 of a public restroom stall door 24. Stall door 24 has an outer edge 25 which when the door is closed is adjacent the door edge 26 of front panel 27. Front panel 27 is shown to have a top edge 28 which is significantly higher than the top edge 23 of door 24.

The stall door holder 10 is inserted over the top edge 23 so that its parallel gripping edges 14 and 15 abut the inner and outer surfaces 29 and 30 of door 24. The extending arms 18 and 19 pass over door edge 26 and abut the inner and outer surfaces 31 and 32 of front panel 27. It is to be understood that in the event the top edge 23 is at the same height as top edge 28, stall door holder 10 may be inserted directly downwardly over the intersection of the door and the panel.

While it is generally most convenient to use the door holder on the top of the door, it is, however, possible to use it over the bottom edge 33 of door 24 wherein it would be inverted 180° with respect to the position shown in FIG. 5.

Preferably, the device is injection molded and formed with a flat face 34 which may be marked with indicia such as the word "occupied." Preferably, the device is fabricated from a bright plastic so that it is highly visible from outside of the stall.

The result is a highly portable, very easy to use device. It is inexpensive to fabricate and intuitive to use.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A portable stall door holding device (10) for use in public rest-rooms comprising:

a straight, elongated, generally C-shaped member having a first end (12), a second end (13), a body (11) whose cross-section spans about 180 degrees or more and a single pair of substantially parallel gripping edges (14,15) for spanning an elongated opening (25) between a stall door and an adjacent vertical panel, said member being fabricated from a stiff but flexible material, said member having a recess (16) that extends diagonally upwardly from about a horizontal midpoint of said first end (12) when said parallel gripping edges (14,15) are oriented downwardly to an upper recess end (17) that is between said first end (12) and said second end (13) thereby forming a pair of extending arms (18,19) at said first end, said recess (16) being open so that if said stall door holding device is viewed from the top with its parallel gripping edges (14,15) directed downwardly, its pair of extending arms (18,19) form an opening capable of receiving an edge of the vertical panel therebetween.

2. The portable stall door holding device for use in public rest-rooms of claim 1 wherein said member is fabricated from a rigid polymer.

3. The portable stall door holding device for use in public rest-rooms of claim 2 wherein said polymer is poly vinyl chloride.

4. The portable stall door holding device for use in public rest-rooms of claim 1 wherein said member is about four inches long.

5. The portable stall door holding device for use in public rest-rooms of claim 4 wherein said recess extends about 1.75 inches back from said first end.

6. The portable stall door holding device for use in public rest-rooms of claim 5 wherein the member has an inside diameter of about 1.25 inches.

7. A method for holding a public rest-room stall door in a closed position, said public rest-room stall door being hingedly mounted to a frame and said stall door having a top edge, a bottom edge, an outer edge and a hinged edge and said frame including a front panel including inner and outer surfaces, a front panel door edge and a front panel top edge said process utilizing a generally elongated C-shaped member having a first end, a second end, a body whose cross-section spans about 180 degrees or more and a pair of substantially parallel gripping edges defined by a recess that extends diagonally upwardly from about a horizontal midpoint of said first end (12) when said parallel gripping edges (14.15) are oriented downwardly to an upper recess end (17) that is between said first end (12) and said second end (13) thereby forming a pair of extending arms (18,19) at said first end for spanning an elongated opening between the stall door and the front panel, said member being fabricated from a stiff but flexible material, the method comprising:

moving the door into a closed position so that the outer edge of the door is adjacent and aligned with the front panel door edge so that the door and the front panel form a straight line when viewed from above; and placing the substantially parallel gripping edges of said generally elongated C-shaped member over one of said top and bottom edges of the stall door near the outer edge thereof and positioning the recess to be adjacent the front panel door edge so that the gripping edges abut the inner and outer surfaces of the front panel thereby holding the door in a closed position.

8. The process of claim 7 further including after the placing step:

sliding the elongated C-shaped member toward and over a portion of said front panel.

* * * * *